US011501894B2

(12) United States Patent
Takakura et al.

(10) Patent No.: US 11,501,894 B2
(45) Date of Patent: Nov. 15, 2022

(54) WIRING MEMBER

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Ryuta Takakura, Mie (JP); Tetsuya Nishimura, Mie (JP); Housei Mizuno, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/297,804

(22) PCT Filed: Dec. 12, 2018

(86) PCT No.: PCT/JP2018/045659

§ 371 (c)(1),
(2) Date: May 27, 2021

(87) PCT Pub. No.: WO2020/121433

PCT Pub. Date: Jun. 18, 2020

(65) Prior Publication Data

US 2022/0051832 A1 Feb. 17, 2022

(51) Int. Cl.

| | |
|---|---|
| ***H01B 7/00*** | (2006.01) |
| ***H01B 7/08*** | (2006.01) |
| ***H01B 3/44*** | (2006.01) |

(52) U.S. Cl.

CPC ..... *H01B 7/0846* (2013.01); *H01B 3/44* (2013.01)

(58) Field of Classification Search

CPC ..... H01B 7/361; H01B 7/0045; H01R 11/20; H01R 13/405

See application file for complete search history.

(56) References Cited

U.S. PATENT DOCUMENTS 3,197,554 A * 7/1965 Baker ..... H01B 7/365 174/112
3,994,090 A * 11/1976 Wheeler ..... H02G 15/117 29/748

(Continued)

FOREIGN PATENT DOCUMENTS

CN 103794271 5/2014
JP S60-020200 A 2/1985

(Continued)

OTHER PUBLICATIONS

International Search Report, WIPO, Application No. PCT/JP2018/045659, dated Feb. 26, 2019, English translation.

(Continued)

*Primary Examiner* — Chau N Nguyen
(74) *Attorney, Agent, or Firm* — Greenblum & Bernstein, P.L.C.

(57) ABSTRACT

A wiring member includes a plurality of wire-like transmission member groups, a plurality of connectors, and a base member. Each of the plurality of wire-like transmission member groups includes a plurality of wire-like transmission members. End portions of the wire-like transmission members are connected to the plurality of connectors. The base member planarly positions and holds at least intermediate parts of the plurality of wire-like transmission member groups.

4 Claims, 4 Drawing Sheets

(56) References Cited

U.S. PATENT DOCUMENTS

| | | | | | |
|---|---|---|---|---|---|
| 4,065,199 | A * | 12/1977 | Andre | H01B 7/08 | 439/498 |
| 4,210,773 | A * | 7/1980 | Haley | H01B 7/0853 | 174/72 A |
| 9,825,394 | B2 * | 11/2017 | Naganishi | B60R 16/0207 | |
| 2014/0283989 | A1 | 9/2014 | Takano | | |

FOREIGN PATENT DOCUMENTS

| | | | |
|---|---|---|---|
| JP | S61-006576 | A | 2/1986 |
| JP | H07-312239 | A | 11/1995 |
| JP | H09-050713 | A | 2/1997 |
| JP | 2004-038010 | A | 2/2004 |
| JP | 2006-286299 | A | 10/2006 |
| JP | 2014-186800 | A | 10/2014 |
| JP | 2014-207738 | A | 10/2014 |
| JP | 2016-009521 | A | 1/2016 |

OTHER PUBLICATIONS

International Preliminary Report on Patentability, WIPO, Application No. PCT/JP2018/045659, dated Mar. 11, 2021.

Office Action, Japan Patent Office, in counterpart Japanese Patent Application No. 2020-559601, dated Mar. 1, 2022 (with English translation).

Office Action, China Patent Office, in counterpart Chinese Application No. 201880099745.4, dated May 12, 2022 (with English translation).

* cited by examiner

WIRING MEMBER

TECHNICAL FIELD

The present invention relates to a wiring member.

BACKGROUND ART

Patent Document 1 discloses a wire harness including a wire harness body having a plurality of electrical wires and a protector housing the wire harness body.

PRIOR ART DOCUMENTS

Patent Documents

Patent Document 1: Japanese Patent Application Laid-Open No. 2014-207738

SUMMARY

Problem to be Solved by the Invention

In a technique described in Patent Document 1, the wire harness body is formed of a plurality of electrical wires in a bundle. At this time, in a terminal part of the wire harness body, the electrical wire can be easily identified by checking which cavity of a connector an end portion of the electrical wire is housed in. When all the electrical wires are color-coded, the electrical wire can be identified also in an intermediate part of the wire harness body. However, it is hard to identify the electrical wire in the intermediate part of the wire harness body when the electrical wires have the same color.

An object of the present invention is to provide a technique of easily identifying a wire-like transmission member also in an intermediate part of the wiring member.

Means to Solve the Problem

In order to solve the above problem, a wiring member according to a first aspect includes: a plurality of wire-like transmission member groups each including a plurality of wire-like transmission members; a plurality of connectors to which end portions of the wire-like transmission members are connected; and a base member planarly positioning and holding at least intermediate parts of the plurality of wire-like transmission member groups, wherein each of the plurality of wire-like transmission members includes a transmission wire body and a covering for covering the transmission wire body, the base member includes a sheet member having a main surface on which at least the intermediate parts of the plurality of wire-like transmission member groups are fixed, the wire-like transmission members intersect with each other on the sheet member, thereby forming an intersecting part, and each of the plurality of wire-like transmission members is individually fixed along a predetermined route on the sheet member, and the plurality of wire-like transmission members are positioned in a predetermined order of arrangement.

A wiring member according to a second aspect is the wiring member according to the first aspect, wherein the intersecting part includes a position-switching intersecting part in which the wire-like transmission members whose both ends are connected to identical connectors intersect with each other for switching a position.

A wiring member according to a third aspect is the wiring member according to the first or the second aspect, wherein the plurality of wire-like transmission member groups include wire-like transmission members each provided with the covering having an identical color.

A wiring member according to a fourth aspect is the wiring member according to any one of the first to third aspects, wherein two or more wire-like transmission member groups in the plurality of wire-like transmission member groups extend from one connector in the plurality of connectors.

A wiring member according to a fifth aspect is the wiring member according to any one of the first to third aspects, wherein two or more wire-like transmission member groups in the plurality of wire-like transmission member groups extend from each of a first connector and a second connector in the plurality of connectors.

Effects of the Invention

According to each aspect, at least the intermediate parts of the plurality of wire-like transmission member groups are planarly positioned by the base member. Positional data of the plurality of wire-like transmission member groups can be already known from data at the time of manufacturing the wiring member, for example. Accordingly, positional information of the desired wire-like transmission member in the wiring member is checked against the known positional data of the plurality of wire-like transmission member groups, thus the wire-like transmission member can be identified easily also in the intermediate part of the wiring member.

And, according to the first aspect, the wiring member can be formed using the wire-like transmission member with the covering.

According to the third aspect, even when the coverings of the plurality of wire-like transmission member groups have the same color, each wire-like transmission member is positioned by the base member, thus can be easily identified.

According to the fourth aspect, the wire-like transmission member can be easily identified also in the wiring member in which two or more wire-like transmission member groups in the plurality of wire-like transmission member groups extend from one connector.

According to the fifth aspect, the wire-like transmission member can be easily identified also in the wiring member in which two or more wire-like transmission member groups in the plurality of wire-like transmission member groups extend from each of the first connector and the second connector.

DESCRIPTION OF EMBODIMENT(S)

First Embodiment

Figure 1:
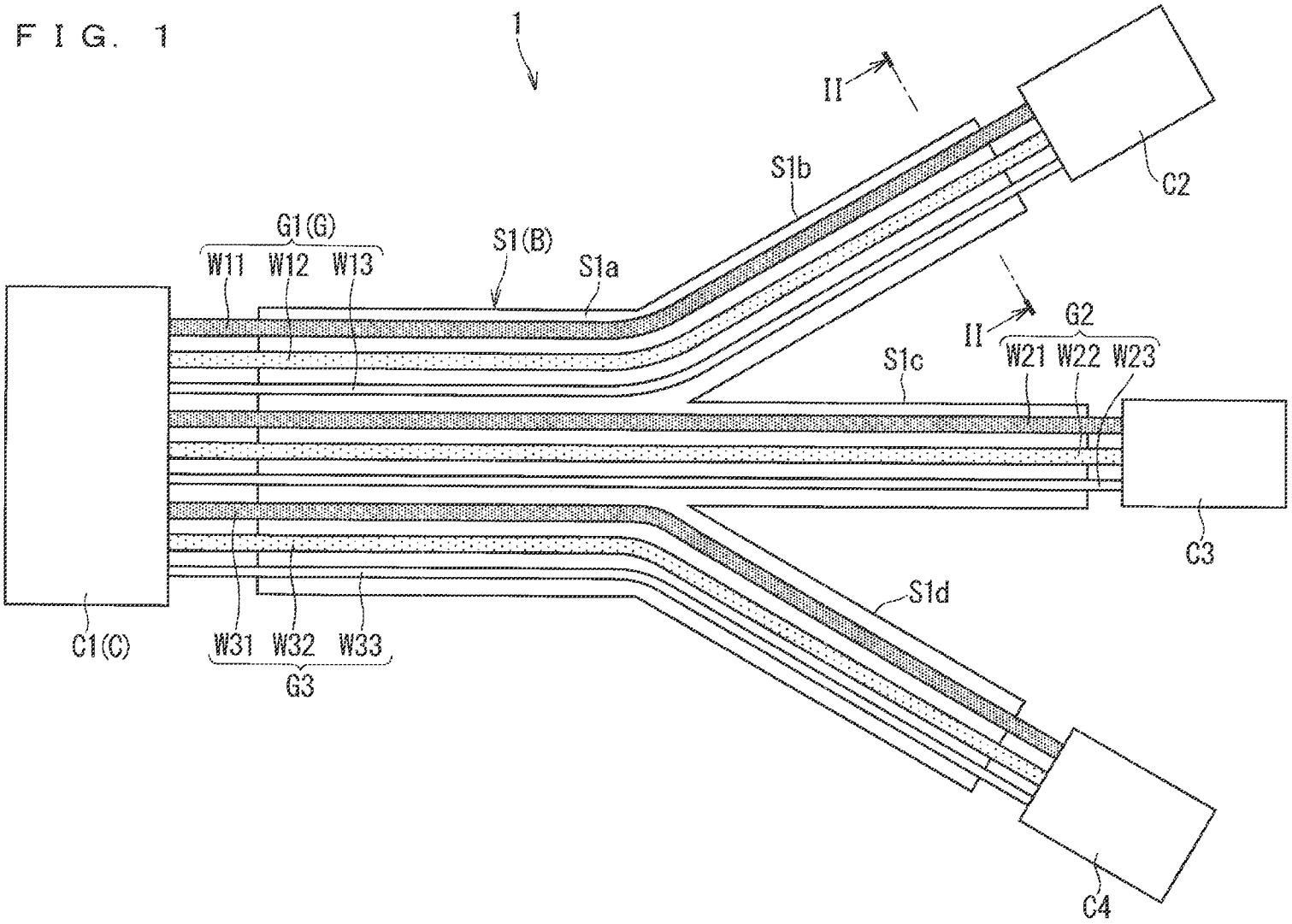
FIG. 1 A plan view illustrating a wiring member according to a first embodiment.
Figure 2:
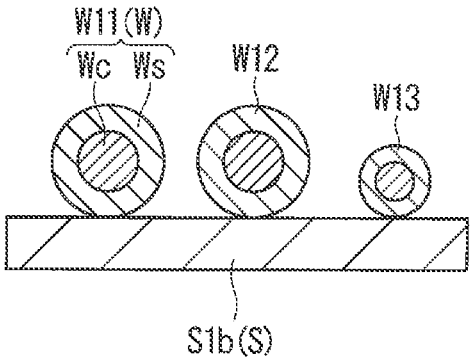
FIG. 2 A cross-sectional view of the wiring member cut along a II-II line in FIG. 1.

A wiring member according to a first embodiment is described hereinafter. FIG. 1 is a plan view illustrating a wiring member according to the first embodiment. FIG. 2 is a cross-sectional view of the wiring member cut along a II-II line in FIG. 1. In the example illustrated in FIG. 1, a presence or absence of a hatching and a difference thereof in a wire-like transmission member W express a difference in color of a covering Ws.

The wiring member includes a plurality of (three herein) wire-like transmission member groups G, a plurality of (four herein) connectors C, and a base member B. When the three wire-like transmission member groups G need to be distinguished, they may be referred to as the wire-like transmission member groups G1, G2, and G3 in some cases hereinafter. When the four connectors C need to be distinguished, they may be referred to as the connectors C1, C2, C3, and C4 in some cases. It is obvious that the number of the wire-like transmission member groups G may be two, or may also be four or more. The number of the connectors C may be two or three, or may also be five or more.

Each of the plurality of wire-like transmission member groups G includes a plurality of wire-like transmission members W. In the example illustrated in FIG. 1, the wire-like transmission member group G1 includes wire-like transmission members W11, W12, and W13, the wire-like transmission member group G2 includes wire-like transmission members W21, W22, and W23, and the wire-like transmission member group G3 includes wire-like transmission members W31, W32, and W33. The number of the wire-like transmission members W included in one wire-like transmission member group G may be two, or may also be four or more. The number of the wire-like transmission members W included in each of the plurality of wire-like transmission member groups G may not be the same as each other.

One wire-like transmission member group G indicates one group of positive and negative power wires and a signal line in one auxiliary machine, for example. The plurality of wire-like transmission members W in the one wire-like transmission member group G are generally connected to the same connector C.

It is sufficient that the wire-like transmission member W is a wire-like member transmitting electrical power or light, for example. For example, the wire-like transmission member W may be a general wire having a core wire and a covering around the core wire, or may also be a bare conductive wire, a shielded wire, an enamel wire, a nichrome wire, or an optical fiber.

The wire-like transmission member W transmitting the electrical power may be various kinds of signal lines or various kinds of power lines. The wire-like transmission member W transmitting the electrical power may be used as an antenna or coil, for example, transmitting or receiving a signal or electrical power to or from a space.

Herein, each of the plurality of wire-like transmission members W includes a transmission wire body We transmitting electrical power or light, for example, and a covering Ws covering the transmission wire body Wc. For example, when the wire-like transmission member W is a general wire, the transmission wire body We corresponds to a core wire in the general wire, and the covering Ws corresponds to an insulating covering for covering the core wire. The core wire is made up of one or a plurality of strands. The strand is formed of a conductor made of copper, copper alloy, aluminum, or aluminum alloy, for example. When the core wire is made up of the plurality of strands, the plurality of strands may be stranded. The insulating covering is formed of a resin material such as polyvinyl chloride (PVC) or polyethylene (PE) extrusion-molded around the core wire. The wire-like transmission member W is formed into a round shape in cross section herein.

In one wire-like transmission member group G, the coverings Ws of the wire-like transmission members W are color-coded into colors different from each other. In the example illustrated in FIG. 1, in the wire-like transmission member group G1, the coverings Ws of the wire-like transmission members W11, W12, and W13 are color-coded into colors different from each other. In the wire-like transmission member group G2, the coverings Ws of the wire-like transmission members W21, W22, and W23 are color-coded into colors different from each other. In the wire-like transmission member group G3, the coverings Ws of the wire-like transmission members W31, W32, and W33 are color-coded into colors different from each other. However, in one wire-like transmission member group G, the covering Ws may include the wire-like transmission members W having the same color, or all of them may have the same color.

The plurality of wire-like transmission member groups G include the wire-like transmission members W whose coverings Ws have the same color. In the example illustrated in FIG. 1, in the wire-like transmission member groups G1, G2, and G3, the coverings Ws of the wire-like transmission members W11, W21, and W31 have the same color. In the wire-like transmission member groups G1, G2, and G3, the coverings Ws of the wire-like transmission members W12, W22, and W32 have the same color. In the wire-like transmission member groups G1, G2, and G3, the coverings Ws of the wire-like transmission members W13, W23, and W33 have the same color.

The wire-like transmission members W whose coverings Ws have the same color in the plurality of wire-like transmission member groups G may be used for the same purpose of use, for example. For example, it is applicable that the wire-like transmission members W11, W21, and W31 are positive power wires, respectively, the wire-like transmission members W12, W22, and W32 are negative power wires, respectively, and the wire-like transmission members W13, W23, and W33 are signal lines, respectively. With regard to the positive and negative power wires, the positive power wire is simply referred to as a power wire, and the negative power wire is referred to as a ground wire or an earth wire in some cases.

End portions of the wire-like transmission members W are connected to the plurality of connectors C. In the example illustrated in FIG. 1, one end portions of the wire-like transmission members W of the wire-like transmission member groups G1, G2, and G3 are all connected to the connector C1. Accordingly, two or more wire-like transmission member groups G1, G2, and G3 in the plurality of wire-like transmission member groups G extend from one connector C1 in the plurality of connectors C. The other one end portions of the wire-like transmission members W of the wire-like transmission member group G1 are all connected to the connector C2. The other one end portions of the wire-like transmission members W of the wire-like transmission member group G2 are all connected to the connector C3. The other one end portions of the wire-like transmission members W of the wire-like transmission member group G3 are all connected to the connector C4.

A connection destination of the connector C is determined in accordance with a type of the wiring member, thus is not particularly limited. For example, in the description of the example illustrated in FIG. 1, the connector C1 is connected to an electronic control unit (ECU), and the connectors C2, C3, and C4 are connected to various sensors.

In the description of the example illustrated in FIG. 1, the plurality of wire-like transmission members W are all connected to one stage in the connector C, however, this configuration is not necessary. The plurality of wire-like transmission members W may be separately connected to a plurality of stages.

The base member B planarly positions and holds at least intermediate parts of the plurality of wire-like transmission member groups G. Herein, the base member B planarly positions and holds only the intermediate parts of the plurality of wire-like transmission member groups G, but may also planarly positions and holds an area extending to end portions of the plurality of wire-like transmission member groups G, and a connector may be further disposed on the base member B.

It is sufficient that the base member B in a state of being disposed in an operation position, for example, holds the wire-like transmission member group G in a state of being planarly positioned. Thus, the base member B may be a flexible sheet-like member which can be bended easily. The base member B may be a sheet-like member having rigidity with a degree of being able to be curved and hold the wire-like transmission member group G in a state of being two-dimensionally positioned, or may be a sheet-like member having rigidity with a degree of being able to keep itself in a flat state and hold the wire-like transmission member group G in a state of being two-dimensionally positioned. The base member B may have a three-dimensional shaped part such as a part made up of a wall partially standing on the base member B.

In the description herein, the base member B is the sheet member S which can be bended. Each description on the sheet member S is applicable to the base member B except for a configuration to which the description is not applicable.

A material constituting the sheet member S is not particularly limited, however, the sheet member S is preferably formed of a material containing a resin of polyvinyl chloride (PVC), polyethylene terephthalate (PET), or polypropylene (PP). The sheet member S may be the sheet member S with an inner portion evenly filled or a non-woven sheet, for example. The sheet member S may contain a material such as metal. The sheet member S preferably has flexibility of easily bending in a thickness direction. The sheet member S may be made up of a single layer or a plurality of stacked layers. When the sheet member S is made up of the plurality of stacked layers, it is considered that a resin layer and a resin layer are stacked, for example. It is also considered that a resin layer and a metal layer are stacked, for example.

The wire-like transmission member W is fixed to one main surface of the sheet member S. The wire-like transmission member W is fixed along a predetermined route on one main surface of the sheet member S. In the example illustrated in FIG. 1, the plurality of wire-like transmission members W are branched on the sheet member S, but may not be branched. In the example illustrated in FIG. 1, the route of the wire-like transmission member W on the sheet member S forms a straight line except for the branch part, but may also be midway bended.

The sheet member S is formed into a shape following the route of the plurality of wire-like transmission member groups G described above. Herein, a sheet member S1 formed into a branch shape is provided as the sheet member S. However, the sheet member S may be formed into one large quadrangular shape, for example.

The branch occurs in the sheet member S1 in accordance with the branched wire-like transmission member group G. The sheet member S1 includes a first fixing part following routes along which the two or more wire-like transmission member groups G extend in parallel to each other and a second fixing part following routes after one wire-like transmission member group G is branched from the other wire-like transmission member group G. Specifically, the sheet member S1 includes, as the first fixing part, a first fixing part Sla following routes along which the wire-like transmission member groups G1, G2, and G3 extend in parallel to each other. The sheet member S1 includes, as the second fixing part, a second fixing parts S1*b*, S1*c*, and S1*d* following routes along which each of the wire-like transmission member groups G1, G2, and G3 independently extend after the wire-like transmission member groups G1, G2, and G3 are branched.

Applicable as a state of fixing the wire-like transmission member W and the sheet member S is a contact area fixation and a non-contact area fixation, or both fixations may be used together. Herein, the contact area fixation indicates that a portion where the wire-like transmission member W and the sheet member S have contact with each other is stuck and fixed. The non-contact area fixation indicates the fixing state which is not the contact area fixation. For example, a sewing thread, the other sheet member, or an adhesive tape presses the wire-like transmission member W toward the sheet member S, or a sewing thread, the other sheet member, or an adhesive tape surrounds the wire-like transmission member W and the sheet member S, thereby holding the wire-like transmission member W and the sheet member S to keep the wire-like transmission member W and the sheet member S fixed to each other. In the description hereinafter, the wire-like transmission member W and the sheet member S are in the state of the contact area fixation. Each description on the contact area fixation is also applicable to the non-contact area fixation as long as each member and material has a configuration to which the non-contact area fixation is not applicable.

Applicable as the configuration of the contact area fixation are a contact area indirect fixation and a contact area direct fixation, or both fixations may also be used together in different regions. Herein, the contact area indirect fixation indicates that the wire-like transmission member W and the sheet member S are indirectly stuck and fixed via an intervening member such as an adhesive agent, a gluing agent, and a double-sided adhesive tape provided therebetween. The contact area direct fixation indicates that the wire-like transmission member W and the sheet member S are directly stuck and fixed without an intervention of the adhesive agent, for example, which is separately provided. Considered in the contact area direct fixation is that resin included in at least one of the wire-like transmission member W and the sheet member S is melted, thus the wire-like transmission member W and the sheet member S are stuck and fixed, for example. In the description hereinafter, the wire-like transmission member W and the sheet member S are in the state of the contact area direct fixation. Each description on the contact area direct fixation is also applicable to the contact area indirect fixation as long as each member and material has a configuration to which the contact area indirect fixation is applicable.

In forming the state of such a contact area direct fixation, the resin is considered to be melted by heat or a solvent, for example. That is to say, the state of the contact area direct fixation may be the state of the contact area direct fixation by the heat or the state of the contact area direct fixation by the solvent. The contact area direct fixation by the heat is preferable.

At this time, a means of forming the state of the contact area direct fixation is not particularly limited, but various means including a known means such as welding, fusion, and melting joint can be used. For example, when the state of the contact area direct fixation by the heat is formed by welding, various welding means such as ultrasonic welding, heating-pressurizing welding, hot air welding, and high frequency welding can be adopted. When the state of the contact area direct fixation is formed by these means, the wire-like transmission member W and the sheet member S are in the state of the contact area direct fixation by these means. Specifically, when the state of the contact area direct fixation is formed by the ultrasonic welding, for example, the wire-like transmission member W and the sheet member S are in the state of the contact area direct fixation by the ultrasonic welding. A portion where the state of the contact area direct fixation by the heat is formed by the welding (a fixing portion between the wire-like transmission member W and the sheet member S) may be referred to as a welding part, and herein, the fixing portion by the ultrasonic welding may be referred to as an ultrasonic welding part, and the fixing portion by the heating-pressurizing welding may be referred to as a heating-pressurizing welding part, for example.

In the case of the contact area direct fixation, only the resin included in the covering Ws of the wire-like transmission member W may be melted, or only the resin included in the sheet member S may be melted. In these cases, the resin which has been melted is stuck on an outer surface of the resin on the other side, and a relatively clear interface may be formed in some cases. In the case of the contact area direct fixation, both the resin included in the covering Ws of the wire-like transmission member W and the resin included in the sheet member S may be melted. In this case, there may be a case where both the resins are mixed and a clear interface is not formed. Particularly, when the covering Ws of the wire-like transmission member W and the sheet member S include compatible resin such as the same resin material, for example, there may be a case where both the resins are mixed and a clear interface is not be formed.

According to the wiring member 1 having the above configuration, at least the intermediate parts of the plurality of wire-like transmission member groups G are planarly positioned by the base member B. Positional data of the plurality of wire-like transmission member groups G can be already known from data at the time of manufacturing the wiring member 1, for example. Accordingly, positional information of the desired wire-like transmission member W in the wiring member 1 is checked against the known positional data of the plurality of wire-like transmission member groups G, thus the wire-like transmission member W can be identified easily also in the intermediate part of the wiring member 1.

Each of the plurality of wire-like transmission members W includes the transmission wire body Wc and the covering Ws for covering the transmission wire body Wc, and the base member B includes the sheet member S having the main surface on which at least the intermediate parts of the plurality of wire-like transmission member groups G are fixed, thus the wiring member 1 can be formed using the wire-like transmission member W provided with the covering Ws. The wiring member 1 is formed using the wire-like transmission member W provided with the covering Ws, thus a degree of freedom of the route of each wire-like transmission member W is increased. At this time, even when there is wire-like transmission members W whose coverings Ws have the same color in the plurality of wire-like transmission member groups G, each wire-like transmission member W is positioned by the base member B, thus can be easily identified.

Two or more wire-like transmission member groups G1, G2, and G3 in the plurality of wire-like transmission member groups G extend from one connector C1. Also in the wiring member 1 in which the large number of wire-like transmission members W are connected to one connector C1 in this manner, the wire-like transmission member W can be easily identified.

Second Embodiment

Figure 3:
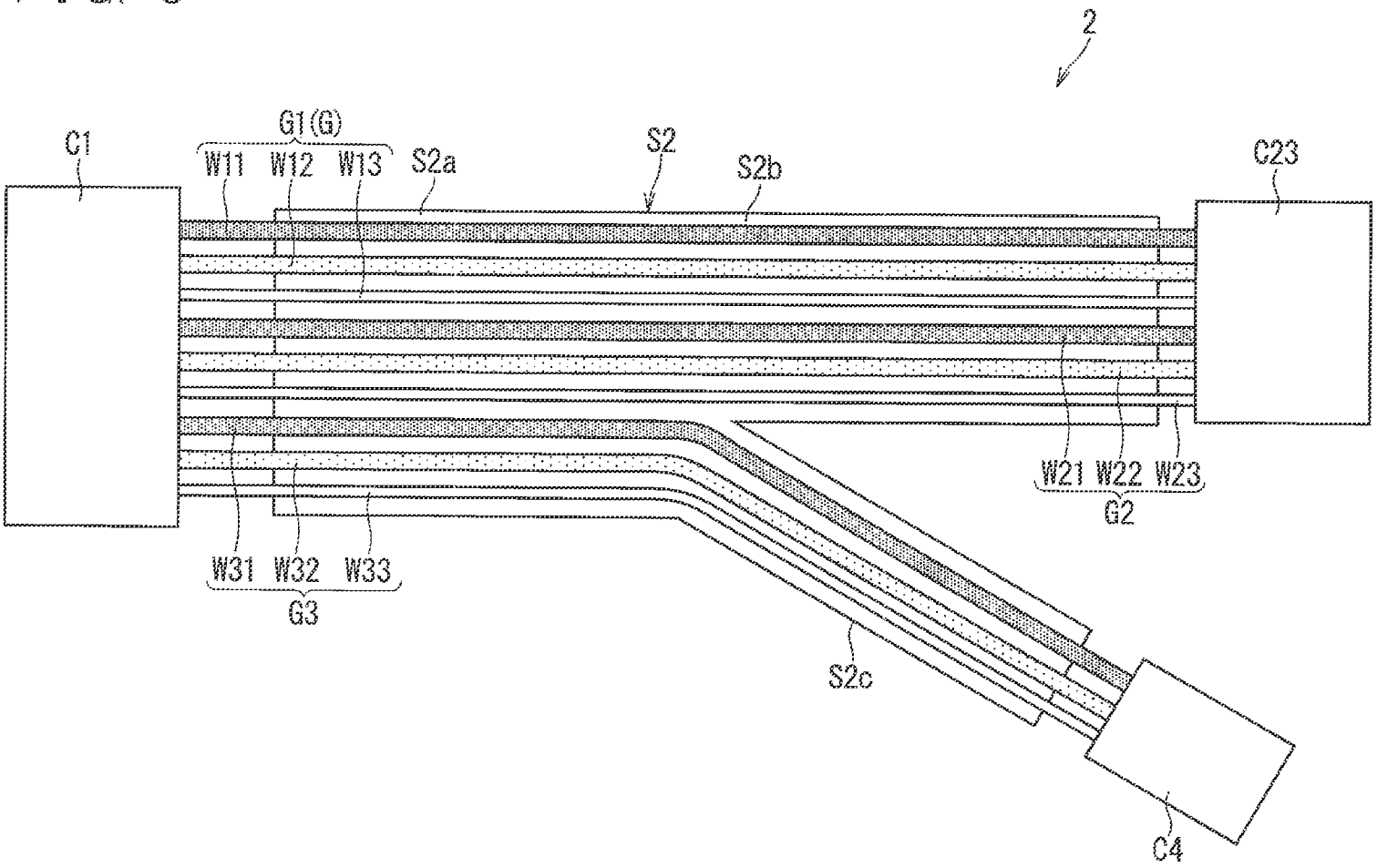
FIG. 3 A plan view illustrating a wiring member according to a second embodiment.

A wiring member 2 according to a second embodiment is described. FIG. 3 is a plan view illustrating a wiring member according to the second embodiment. In the following description of the present embodiment, the same reference numerals are assigned to the similar constituent elements described above, and the description thereof will be omitted.

In the wiring member 2 according to the second embodiment, routes and connection destinations of the wire-like transmission member groups G1 and 02 are different from those of the wire-like transmission member groups G1 and 02 in the wiring member 1 according to the first embodiment.

Specifically, in the wiring member 2, the wire-like transmission member groups G1 and G2 are not branched. Connectors C1, C23, and C4 are provided as the plurality of connectors C. The other one end portions of the wire-like transmission members W of the wire-like transmission member groups G1 and G2 are all connected to the connector C23. Accordingly, two or more wire-like transmission member groups G1, G2, and G3 in the plurality of wire-like transmission member groups G extend from the first connector C1 in the plurality of connectors C. Two or more wire-like transmission member groups G1 and G2 in the plurality of wire-like transmission member groups G extend from the second connector C23 in the plurality of connectors C.

When two or more wire-like transmission member groups G in the plurality of wire-like transmission member groups G extend from each of the first and second connectors C in the plurality of connectors C, it is considered that two or more wire-like transmission member groups G extending from one of the first and second connectors C coincide with two or more wire-like transmission member groups G extending from the other one of the first and second connectors C, or are included in two or more wire-like transmission member groups G extending from the other one of the first and second connectors C. In the present example, two or more wire-like transmission member groups G1 and G2 extending from the second connector C23 are included in two or more wire-like transmission member groups G1, G2, and G3 extending from the first connector C1, the there is no different wire-like transmission member group G.

The sheet member S2 in the present example is formed into a shape in accordance with the routes of the wire-like transmission member groups G1, G2, and G3. Specifically, the sheet member S2 includes, as the first fixing part, a first fixing part S2*a* following routes along which the wire-like transmission member groups G1, G2, and G3 extend in parallel to each other and a first fixing part S2*b* following routes along which the wire-like transmission member groups G1 and G2 extend in parallel to each other after the wire-like transmission member groups G1 and 02 and the wire-like transmission member group G3 are branched from each other. The sheet member S2 includes, as the second fixing part, a second fixing part S2*c* following a route along which the wire-like transmission member group G3 independently extends after the wire-like transmission member groups G1 and G2 and the wire-like transmission member group G3 are branched from each other.

According to the present embodiment, two or more wire-like transmission member groups G1 and G2 in the plurality of wire-like transmission member groups G extend from the first connector C1 and the second connector C23. Also in the wiring member 2 in which the large number of wire-like transmission members W are connected to the first connector C1 and the second connector C23 in this manner, the wire-like transmission member W can be easily identified.

Third Embodiment

Figure 4:
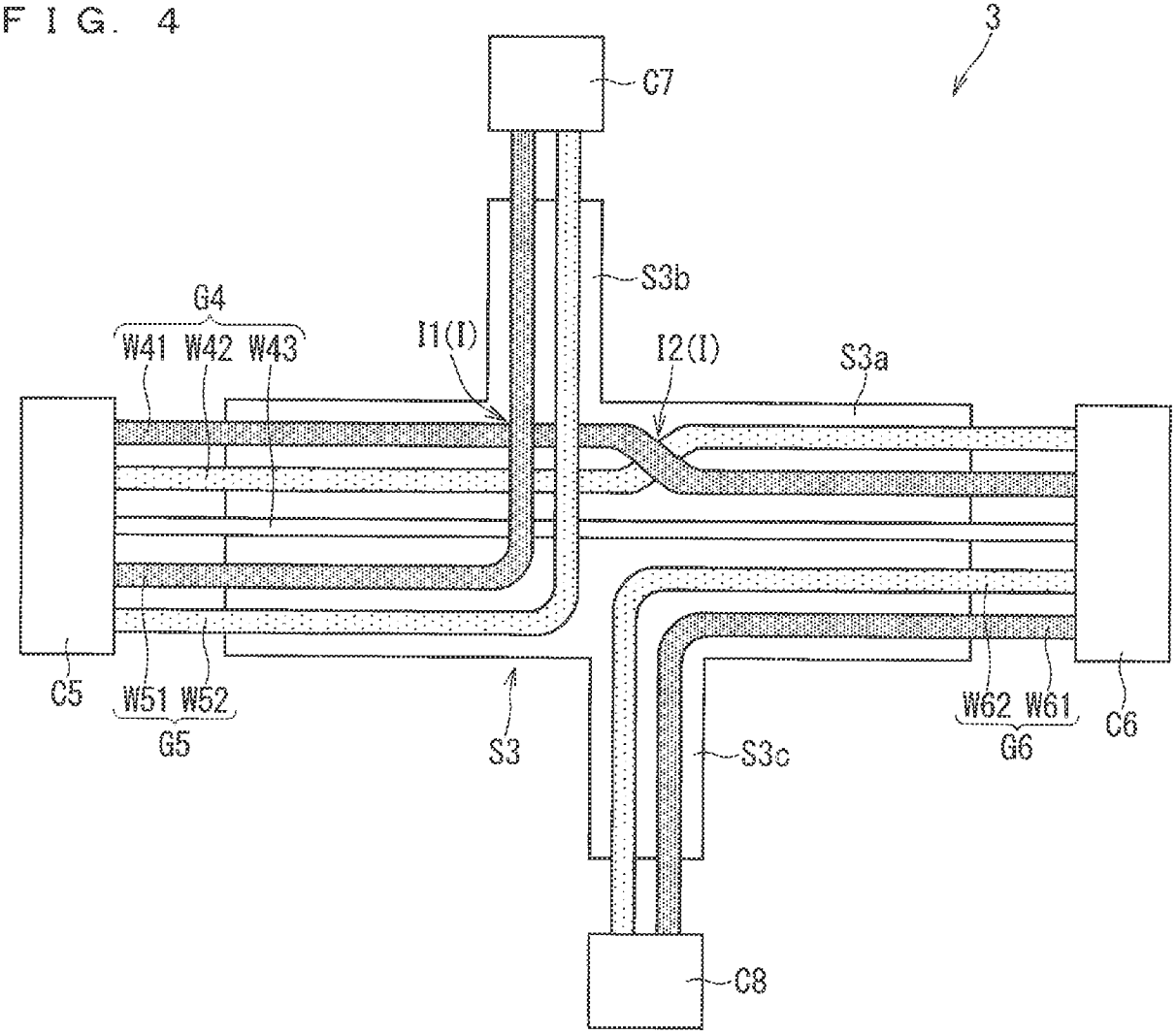
FIG. 4 A plan view illustrating a wiring member according to a third embodiment.

A wiring member according to a third embodiment is described. FIG. 4 is a plan view illustrating a wiring member 3 according to the third embodiment. In the following description of the present embodiment, the same reference numerals are assigned to the similar constituent elements described above, and the description thereof will be omitted.

In the wiring member 3 according to the third embodiment, wire-like transmission member groups G4, G5, and G6 are provided as the wire-like transmission member group G. The wire-like transmission member group G4 includes wire-like transmission members W41, W42, and W43. The wire-like transmission member group G5 includes wire-like transmission members W51 and W52. The wire-like transmission member group G6 includes wire-like transmission members W61 and W62.

Connectors C5, C6, C7, and C8 are provided as the connectors C in the wiring member 3. The one end portions of the wire-like transmission member groups G4 and G5 are connected to the connector C5. The other one end portions of the wire-like transmission member group G4 and one end portions of the wire-like transmission member group G6 are connected to the connector C6. The other one end portions of the wire-like transmission member group G5 are connected to the connector C7. The other one end portions of the wire-like transmission member group G6 are connected to the connector C8.

Also in the present example, two or more wire-like transmission member groups G extend from the first connector C5 and the second connector C6. However, in the present example, even when two or more wire-like transmission member groups G in the plurality of wire-like transmission member groups G extend from each of the first and second connectors C in the plurality of connectors C, two or more wire-like transmission member groups G extending from one of the first and second connectors C do not coincide with two or more wire-like transmission member groups G extending from the other one of the first and second connectors C, and are not also included in two or more wire-like transmission member groups G extending from the other one of the first and second connectors C.

In the present example, two or more wire-like transmission member groups G4 and G5 extending from the first connector C5 and two or more wire-like transmission member groups G4 and G6 extending from the second connector C6 include the wire-like transmission member group G5 extending from only the first connector C5 and the wire-like transmission member group G6 extending from only the second connector C6 in the first and second connectors C5 and C6. That is to say, the present example indicates a case example that two or more wire-like transmission member groups G in the plurality of wire-like transmission member groups G extend from each of the first and second connectors C in the plurality of connectors C and included are the wire-like transmission member group G extending from only the first connector C and the wire-like transmission member group G extending from only the second connector C in the first and second connectors C.

The sheet member S3 in the present example includes, as the first fixing part, a first fixing part S3*a* in which a portion of the wire-like transmission member group G4 and the wire-like transmission member group G5 extending from the connector C5 and a portion of the wire-like transmission member group G6 extending from the connector C6 are fixed to each other. The sheet member S3 includes, as the second fixing part, a second fixing part S3*b* in which a portion of the wire-like transmission member group G5 extending from the connector C7 and a portion of the wire-like transmission member group G6 extending from the connector C8 are fixed to each other.

The wire-like transmission members W intersect with each other on the sheet member S, thereby forming an intersecting part I. The intersecting part I may be a branch intersecting part I1 formed so that the wire-like transmission member groups G are branched from each other. The intersecting part I may be a position-switching intersecting part I2 formed to switch a position of the wire-like transmission member W in the wire-like transmission member group G.

When the intersecting part I is formed in the sheet member S, there may be a case where an order of arrangement of the wire-like transmission member W differs between one end portion and the other end portion of the wire-like transmission member group G. In such a case, it is hard to identify the wire-like transmission member W in the intermediate part of the wire-like transmission member group G from one end portion or the other end portion of the wire-like transmission member group G. In such a case, the intermediate part of the wire-like transmission member group G is positioned on the sheet member S as with the case of the present wiring member 3, thus the wire-like transmission member W in the intermediate part of the wire-like transmission member group G can be identified easily.

Modification Example

In the above description, the plurality of wire-like transmission member groups G in the wiring members 1, 2, and 3 are branched from each other, however, this configuration is not necessary. The plurality of wire-like transmission member groups G in the wiring member may not be branched but all connected to the same connector C.

In the above description, the covering Ws of the wire-like transmission member W is color-coded in the wire-like transmission member group G, however, this configuration is not necessary. It is also applicable that the covering Ws of the wire-like transmission member W is not color-coded in the wire-like transmission member group G but the covering Ws of the wire-like transmission member W is color-coded between the wire-like transmission member groups G. For example, in the first embodiment described above, it is also applicable that the coverings Ws of the wire-like transmission members W11, W12, and W13 in the wire-like transmission member group G1 are formed to have the same color, the coverings Ws of the wire-like transmission members W21, W22, and W23 in the wire-like transmission member group G2 are formed to have the same color, and the color of the coverings Ws of W11, W12, and W13 is different from that of the coverings Ws of W21, W22, and W23.

In the above description, two or more wire-like transmission member groups G in the plurality of wire-like transmission member groups G extend from at least one connector C in the plurality of connectors C, however, this configuration is not necessary. Also applicable is a configuration that only one wire-like transmission member group G extends from all of the plurality of connectors C.

In the above description, the wire-like transmission member W includes the transmission wire body Wc and the covering Ws, however, this configuration is not necessary. There may also be a case where the wire-like transmission member W is made up of only the transmission wire body We. For example, a conductor may be directly formed on the base member in the wiring member as with flexible printed circuits (FPC). There may also be a case where the base member functions as a covering for collectively covering the plurality of conductors in the wiring member as with a flexible flat cable (FPC), for example.

In the above description, the base member B is the sheet member S, however, this configuration is not necessary. For example, the base member may be an adhesive tape or a protector.

The configurations described in the embodiments and modification examples thereof can be appropriately combined as long as they are not contradictory.

Although the present invention is described in detail, the foregoing description is in all aspects illustrative and does not restrict the invention. It is therefore understood that numerous modifications and variations can be devised without departing from the scope of the invention.

EXPLANATION OF REFERENCE SIGNS

1, 2, 3 wiring member
G wire-like transmission member group
W wire-like transmission member
Wc transmission wire body
Ws covering
C connector
B base member
S sheet member

The invention claimed is:

1. A wiring member, comprising:

a plurality of wire-like transmission member groups each including a plurality of wire-like transmission members;

a plurality of connectors to which end portions of the wire-like transmission members are connected; and a base member planarly positioning and holding at least intermediate parts of the plurality of wire-like transmission member groups, wherein each of the plurality of wire-like transmission members includes a transmission wire body and a covering for covering the transmission wire body, the base member includes a sheet member having a main surface on which at least the intermediate parts of the plurality of wire-like transmission member groups are fixed, the wire-like transmission members intersect with each other on the sheet member, thereby forming an intersecting part, each of the plurality of wire-like transmission members is individually fixed along a predetermined route on the sheet member, and the plurality of wire-like transmission members are positioned in a predetermined order of arrangement, two or more wire-like transmission member groups in the plurality of wire-like transmission member groups extend from one connector in the plurality of connectors, wherein a first group of the two or more wire-like transmission member groups extends to a first opposite end connector among the plurality of connectors, and a second group of the two or more wire-like transmission member groups extends to a second opposite end connector among the plurality of connectors, the first group includes a first wire-like transmission member and a second wire-like transmission member whose covering colors are different from each other, and the second group includes a third wire-like transmission member having a covering of a same color as a covering color of the first wire-like transmission member, and a fourth wire-like transmission member having a covering of a same color as a covering color of the second wire-like transmission member, the wiring member further comprises a third wire-like transmission member group that is not included in the plurality of wire-like transmission member groups, and another connector that is not included in the plurality of connectors, and the third wire-like transmission member group includes a plurality of wire-like transmission members, and the third wire-like transmission member group extends from the another connector to one of the first opposite end connector and the second opposite end connector.

2. The wiring member according to claim 1, wherein the intersecting part includes a position-switching intersecting part in which the wire-like transmission members whose both ends are connected to identical connectors among the plurality of connectors intersect with each other for switching a position.

3. The wiring member according to claim 1, wherein the first group and the second group are branched on the sheet member, and the base member is branched into a shape corresponding to the first group and the second group.

4. The wiring member according to claim 1, wherein the plurality of wire-like transmission members of the third wire-like transmission member group do not intersect with each other and with any of said wire-like transmission members of the plurality of wire-like transmission member groups.

* * * * *